US005603869A

United States Patent [19]

McNew et al.

[11] Patent Number: 5,603,869

[45] Date of Patent: Feb. 18, 1997

[54] FUEL MIXTURE LIMITATION DEVICE

[75] Inventors: James E. McNew, Texarkana, Ark.; Paul Ross, Shreveport, La.; Lamont Lackman, Georgetown, Tex.

[73] Assignee: WCI Outdoor Products, Inc., Cleveland, Ohio

[21] Appl. No.: 325,781

[22] Filed: Oct. 19, 1994

[51] Int. Cl.[6] ..... F02M 3/08

[52] U.S. Cl. ..... 261/71; 261/DIG. 38; 261/DIG. 84; 137/382

[58] Field of Search ..... 261/71, DIG. 84, 261/DIG. 38; 137/382

[56] References Cited

U.S. PATENT DOCUMENTS

| | | | |
|---|---|---|---|
| 3,618,906 | 11/1971 | Charron . | |
| 3,967,811 | 7/1976 | Keller, III . | |
| 4,097,561 | 6/1978 | Seki et al. | 261/DIG. 38 |
| 4,234,523 | 11/1980 | Onuki et al. | 261/DIG. 84 |
| 4,271,095 | 6/1981 | Maeda | 261/DIG. 38 |
| 4,681,134 | 7/1987 | Paris, Sr. | 137/382 |
| 5,048,792 | 9/1991 | Fischer . | |
| 5,055,238 | 10/1991 | Araki . | |
| 5,094,265 | 3/1992 | Jackson et al. | 137/382 |
| 5,236,634 | 8/1993 | Hammett et al. . | |
| 5,252,261 | 10/1993 | Gerhardy | 261/DIG. 38 |

FOREIGN PATENT DOCUMENTS

| | | | |
|---|---|---|---|
| 2204289 | 8/1973 | Germany . | |
| 47-42424 | 8/1970 | Japan . | |
| 641145 | 1/1979 | U.S.S.R. . | |
| 844801 | 7/1981 | U.S.S.R. | 261/DIG. 38 |
| 1198235 | 12/1985 | U.S.S.R. . | |

*Primary Examiner*—Tim R. Miles

*Attorney, Agent, or Firm*—Pearne, Gordon, McCoy & Granger

[57] ABSTRACT

A limitation device which limits post-adjustment rotation of an adjustment screw (10) on single adjustment screw carburetors (20). In one embodiment, the limitation device uses a limiter cap (100, 200) removably attached to the adjustment screw (10) which works in conjunction with a limiter stop (300, 400) attached to the carburetor. In a second embodiment, the limitation device uses a limiter cap (700) removably attached to the adjustment screw (10) which works in conjunction with a plate (600) attached to the carburetor. In either embodiment, the limiter cap (100, 200, 700) presents a first and second rotational stop (110, 210) which cooperates with at least one rotational stop (304, 306, 404, 406, 606) on the limiter stop (300, 400) or plate (600). A special tool and method is also disclosed for installing and removing the device from the carburetor.

11 Claims, 6 Drawing Sheets

Fig.16
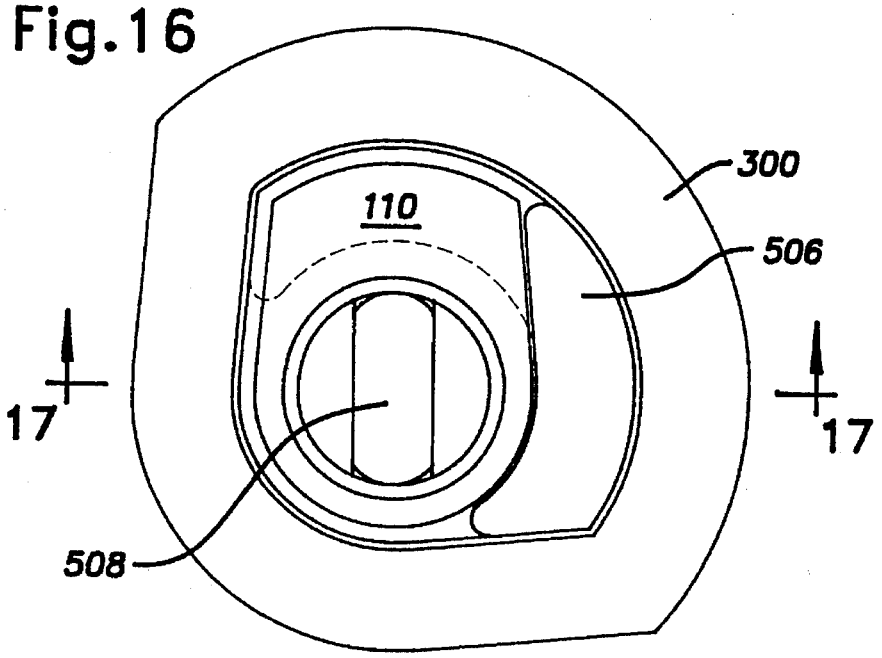
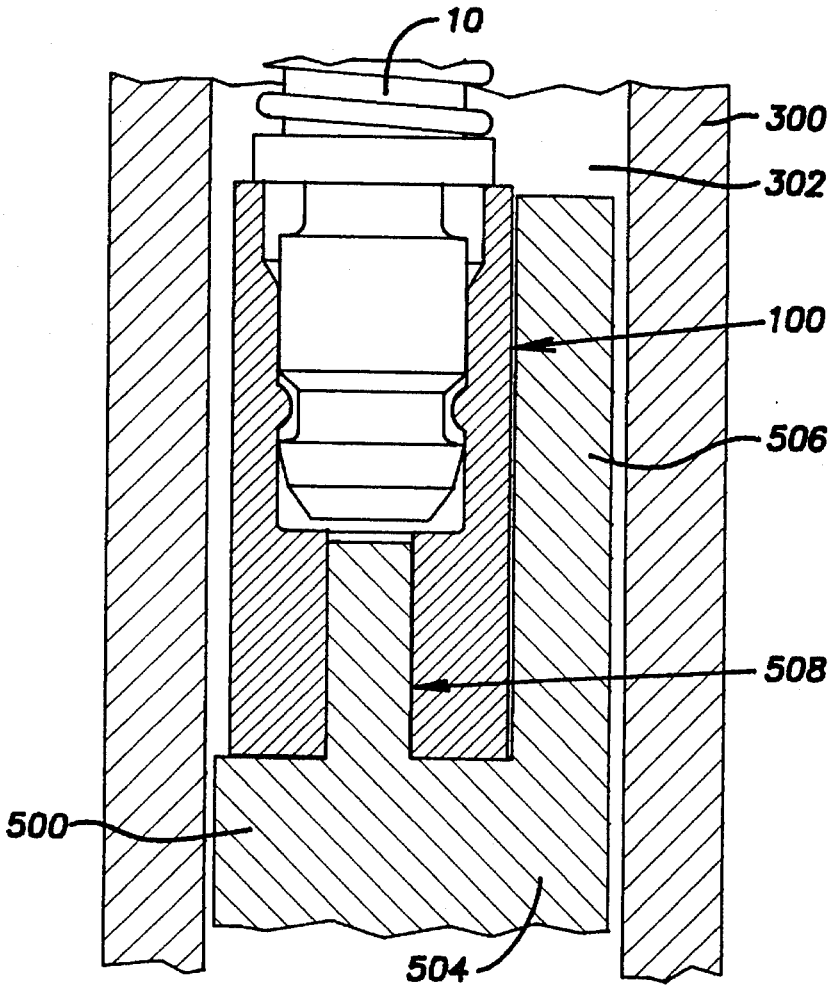
Fig.17

Fig.20
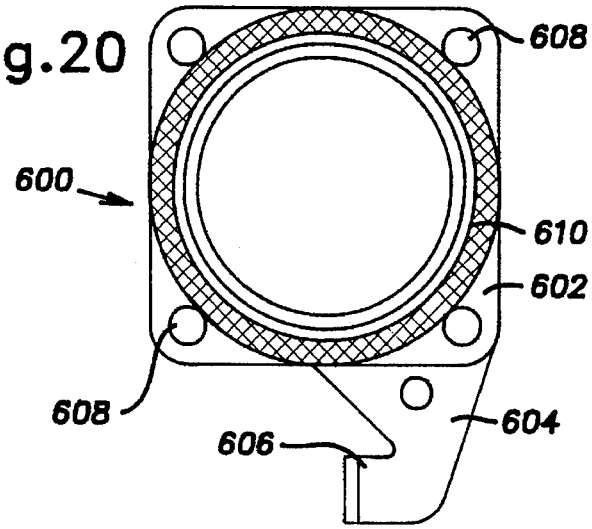
Fig.21
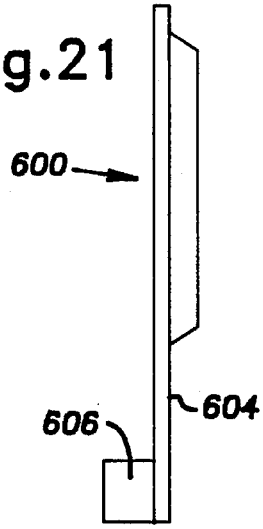
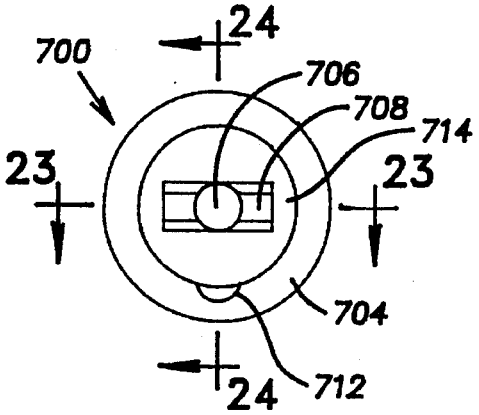
Fig.22
Fig.23
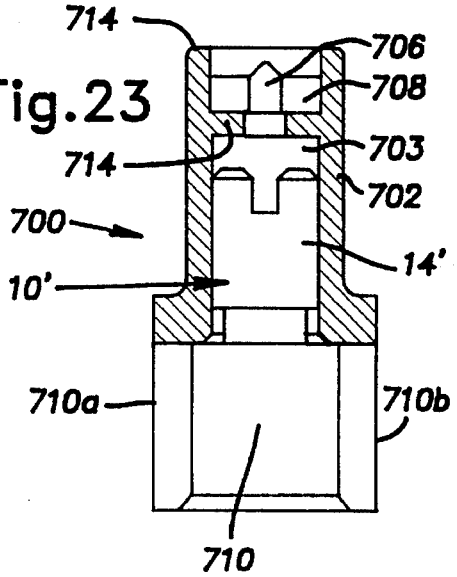
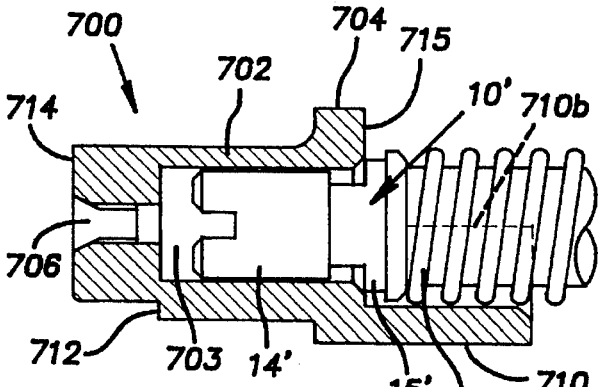
Fig.24
Fig.25
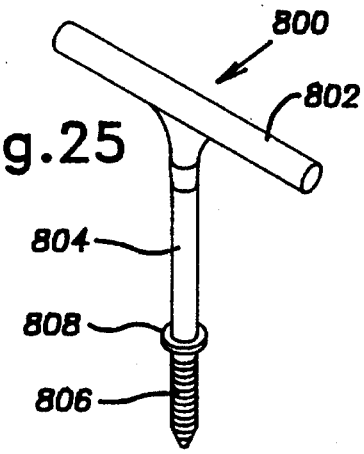

FUEL MIXTURE LIMITATION DEVICE

TECHNICAL FIELD OF THE INVENTION

The present invention generally relates to a device for limiting adjustment of a carburetor fuel mixture adjustment screw, as well as to a tool for installing the limitation device, and a method for installing and removing the device.

BACKGROUND OF THE INVENTION

Environmental protection statutes and regulations are beginning to place limits on the combustion products of small power tools, such as gasoline powered lawn mowers, edgers, chain saws, and line trimmers. Such powered tools usually employ a diaphragm carburetor to control the air/fuel mixture fed to the two-cycle gasoline engine. Fuel is fed to an engine intake path by a fuel pump. The fuel pressure is regulated at a fixed pressure by a fuel pressure regulator. The fuel pressure regulator is equipped with a fuel chamber that stores fuel sent from the fuel pump. A diaphragm that forms one of the fuel chamber walls and a control valve that is interlocked to the motion of the diaphragm opens and closes the fuel chamber inlet. Thus, in any position, fuel is properly supplied to the engine. Fuel travels to the intake path from the fuel chamber through either a main fuel path or an idle fuel path.

A manual fuel mixture adjustment screw is provided for independently controlling the effective areas of the main and idle fuel paths. The adjustment screw includes a needle-shaped valve that can be advanced into or withdrawn from the fuel path. An engine specialist or technician inspects and adjusts each product before shipment to obtain the optimum air/fuel mixture. However, once adjusted, vibration of the power tool can cause the adjustment screw to change from the selected position. Additionally, the power tool user may adjust the adjustment screw's position in an attempt to produce a desired engine output. However, an improper air/fuel ratio resulting from an improperly positioned adjustment screw can produce undesired exhaust output and degrade the performance of the power tool.

Several devices have been developed in response to the need to maintain the adjustment screw in a predetermined position and to limit user-adjustment of the adjustment screw. For example, U.S. Pat. No. 3,618,906 discloses a "Device and Process for Limiting Idling Fuel in Carburetors." The device comprises a polyamide cap that fits tightly over the head of the idling needle. A vane on the cap abuts a boss on the carburetor body to prevent needle rotation in one direction. Internal teeth of the cap fit over the idling needle. A decrease in idling fuel can be effected by rotating the cap and needle in the direction moving the vane away from the boss.

Soviet Patent No. 1,198,235 discloses a carburetor idling system regulator. A regulating needle is threaded into a housing. A bush is attached to the projecting end of the needle and has a radial projection which contacts either front or rear projections on the housing. The front and rear projections limit the rotation of the regulating needle but do not eliminate post-adjustment rotation.

U.S. Pat. No. 5,236,634 provides a pair of needle valves to adjust the main and idle fuel mixture, respectively. A cap is secured to the shank of each needle valve at any one of a series of positions. The caps include radial projections whereby rotation of one cap is limited by engagement of the radial projection with the other cap or with a projection from the carburetor housing or engine.

U.S. Pat. No. 5,055,238 discloses needle valve adjustment screw caps which include radial projections that engage fixed stops on the carburetor body to limit adjustment of the needle valve adjustment screw.

A need exists for a device which can be attached to the adjustment screw of a carburetor. The device must limit the amount of any post-adjustment rotation of the adjustment screw available to the user. However, even though easily installed at the factory, the device must not be easily removed by the end-user.

SUMMARY OF THE INVENTION

The present invention provides a limitation device for limiting rotation of the fuel mixture adjustment screw on single needle carburetors for gasoline powered products. The device is installed on the adjustment screw after the adjustment screw is adjusted at the factory to provide the proper air-fuel ratio.

A first embodiment of the limitation device includes a limiter cap which works in cooperation with a limiter stop. The limiter cap is pushed onto the knurled head of the adjustment screw.

The limiter cap according to the first embodiment of the present invention is a cylindrical structure defining a central cavity. A pair of ribs protrude into the central cavity from an inner surface of the limiter cap and are received within an annular groove in the mixture adjustment screw. A slot is formed in the limiter cap to receive a flat screw driver and allows rotational adjustment of the mixture adjustment screw. The cap also provides an alignment feature for an installation tool. A hole is formed in the cap and aligned with the slot and accepts a screw or specially designed tool for removal of the limiter cap from the head of the adjustment screw. Beneath the slot, a bridge spans the otherwise open interior of the limiter cap and overlies the adjustment screw. The bridge is shaped to cause the cylindrical body of the limiter cap to deform radially outwardly when a screw or removal tool pushes thereagainst, thereby releasing the interference fit between the ribs and the annular groove and allowing for removal of the limiter cap from the mixture adjustment screw.

Alternatively, according to a second embodiment of the limiter cap, the slot can taper inwardly whereby pressure on the tapered slot walls outwardly deforms the cylindrical body of the limiter cap and thereby relieves the interference between the ribs and the annular groove formed in the mixture adjustment screw, allowing for easy removal of the limiter cap. The tapered slot walls can be threaded to receive a threaded screw or a special tool. The first and second embodiments of the limiter cap provide high resistance to pull off while being easily removed from the adjustment screw with an appropriate tool.

In accordance with the present invention, a protrusion extends radially from the cylindrical body of the limiter cap and provides a pair of limit or stop surfaces which engage the limiter stop to limit rotation of the cap and adjustment screw.

In further accordance with the present invention, the limiter stop works in conjunction with the limiter cap. One embodiment of the limiter stop includes an integral metering cover and a tube portion with a central passage which fits around the outer circumference of the limiter cap. The central passage is shaped to provide two rotational stops which are engaged by the stop surfaces of the limiter cap to limit rotation of the cap and mixture adjustment screw. In a second embodiment, the limiter stop includes a neck portion having a hole which aligns with one of the carburetor mounting screws to secure the limiter stop to the carburetor.

Another embodiment of the fuel mixture limitation device provides a plate attached to the carburetor body and a limiter cap which is secured to the adjustment screw. The plate has a planar portion, an extension portion, and an integral tab. A plurality of mounting holes in the planar portion accept mounting screws to attach the plate to the carburetor body. The limiter cap is pressed or pushed on over the knurled head of the mixture adjustment screw. The cap has a cylindrical body which defines a central cavity and a skirt that extends down over a mixture adjustment screw spring. The skirt is semi-cylindrical, and has two edges that are the stopping contact surfaces that, when the cap is rotated, contact or engage the diaphragm cover plate tab.

In summary, the present invention provides a number of advantages over the prior art. Specifically, the limitation device of the present invention limits re-positioning of the mixture adjustment screw in either the fuel rich or fuel lean direction. It also provides a stopping feature that will have minimal effects on surrounding engine components, and no effect on the carburetor casting body. The present design minimizes tolerance build-up, and also provides orientation for an installation tool. The present limitation device is also adaptable to all single needle carburetors.

BRIEF DESCRIPTION OF THE DRAWINGS

For a more complete understanding of the present invention, and for further details and advantages thereof, reference is now made to the following detailed description taken in conjunction with the accompanying drawings in which:

FIGS. 16 and 17 illustrate an installation tool engaging the limiter cap of FIGS. 1–5 and the limiter cap of FIGS. 10–11;

FIG. 20 is a front elevational view of a carburetor diaphragm plate which provides an angled flange;

FIG. 21 is a side elevational view of the diaphragm plate shown in FIG. 20;

FIG. 22 is a top plan view of a limiter cap used in conjunction with the plate shown in FIGS. 20 and 21;

FIG. 23 is a cross-sectional view of the limiter cap as seen along lines 23—23 of FIG. 22;

FIG. 24 is a cross-sectional view of the limiter cap as seen along lines 24—24 of FIG. 22; and FIG. 25 illustrates a special tool for use in removing the limiter cap shown in FIGS. 22–24.

DETAILED DESCRIPTION OF THE PREFERRED EMBODIMENTS

Figure 1:
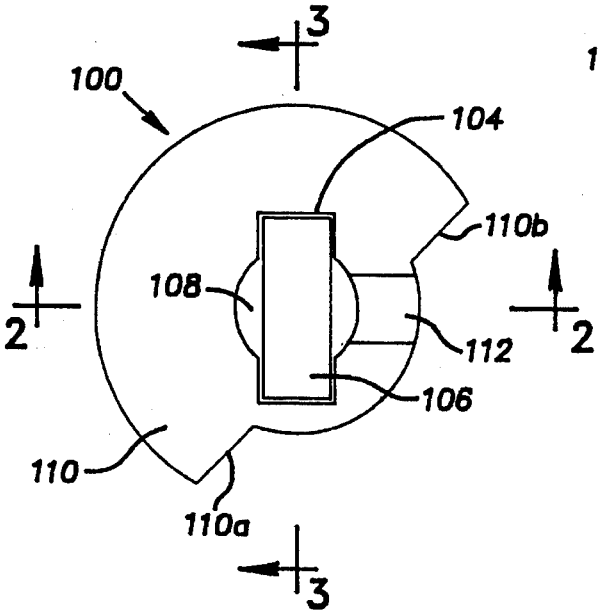
FIG. 1 is a plan view of one embodiment of a limiter cap according to the present invention.
Figure 2:
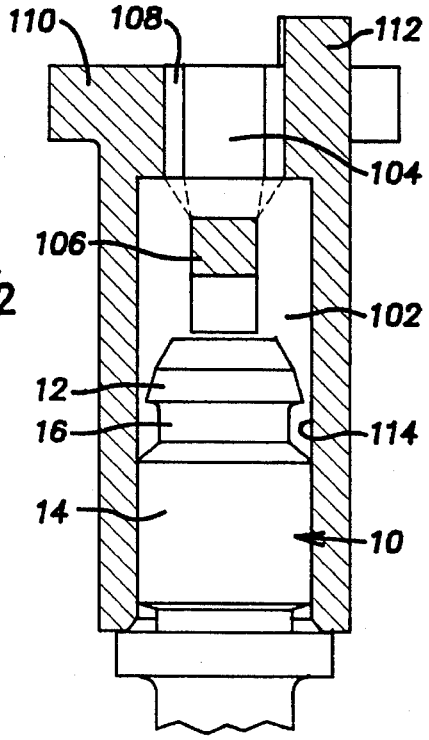
FIG. 2 is an elevational view, in cross-section, of the limiter cap installed over a mixture adjustment screw as viewed along lines 2—2 of FIG. 1.
Figure 3:
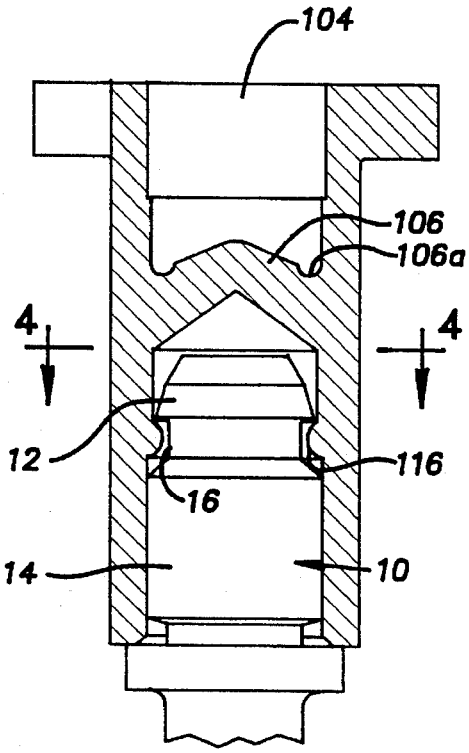
FIG. 3 is an elevational view, in cross-section, of the limiter cap installed over the mixture adjustment screw as viewed along lines 3—3 of FIG. 1.
Figure 4:
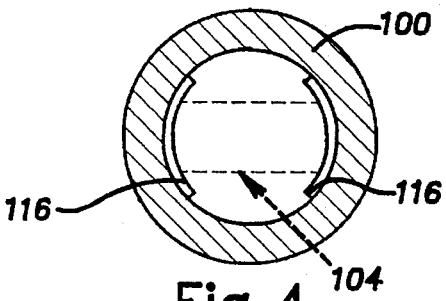
FIG. 4 is a section view of the limiter cap as seen from lines 4—4 of FIG. 3.

The present invention is a fuel mixture adjustment limitation device for single needle adjustment screw carburetors. The first embodiment, shown in FIGS. 1–5, comprises a limiter cap 100, which is attachable to the carburetor mixture adjustment screw 10, and a limiter stop 300, 400 (FIGS. 10–17). The limiter cap 100 is installed over an exposed portion of the carburetor's mixture adjustment screw 10. A distal portion of the adjustment screw 10, not shown, extends into the fuel path of the carburetor and provides a needle-type valve, as is well-known in the art. As shown best in FIGS. 2, 3 and 5, the exposed portion of the adjustment screw 10 includes a knurled portion 14 and a head portion 12 separated by an annular groove 16.

The limiter cap 100 has a cylindrical body which defines a central cavity 102. The limiter cap 100 closely fits over the knurled portion 14 of the mixture adjustment screw 10. A pair of opposed ribs 116 extend or project radially inwardly from the cylindrical interior surface of the limiter cap body. Each of the ribs 116 provide an approximately 90° arc of interference with the annular groove 16 of the mixture adjustment screw 10. The ribs 116 correspond with, and are received by, the annular groove 16 of the mixture adjustment screw 10. When the cap 100 is pushed onto the screw 10, the ribs 116 snap over the head portion 12 of the screw 10 and into the annular groove 16. Frictional engagement between the cylindrical interior surface of the limiter cap body and the knurled portion 14 of the adjustment screw 10 causes the screw 10 to rotate with the limiter cap 100, as will be described more fully hereafter.

A slot 104 in the upper surface of the limiter cap 100 allows for rotational adjustment of the mixture adjustment screw 10 with a flat screw driver and provides an alignment feature for an installation tool. A hole or bore 108 is aligned with the slot 104 and is sized and dimensioned to accept a screw or specially designed tool for removal of the limiter cap 100.

At the bottom of the slot 104, a bridge 106 extends across the otherwise open interior of the cap body. The bridge 106 is adapted and shaped to cause the cylindrical body of the cap 100 to deform radially outwardly and away from the adjustment screw 10 when a screw (not shown) or removal tool (not shown) is inserted through the hole 108 and engages the bridge 106. This action reduces or relieves the interference between the ribs 116 and the annular groove 16 and the frictional engagement between the limiter cap body and the knurled portion 14, allowing for easy removal of the limiter cap 100 from the screw 10.

A radially extending protrusion 110 from the body provides interference with a limiter stop, as will be discussed more fully hereafter. The radial protrusion is illustrated in FIGS. 1–3 and 5 as being at a top of the limiter cap, but may be located at different locations up and down the body of the limiter cap, as shown in FIGS. 10, 11, and 14–16, and is preferably shaped in such a fashion as to provide a pair of radially spaced-apart stop surfaces 110*a*, 110*b*. An axial protrusion 112 extends from the cylindrical body of the limiter cap 100 and provides another stop which may be used to limit rotation of the limiter cap and mixture adjustment screw 10 and provide alignment for an installation or removal tool.

Figure 5:
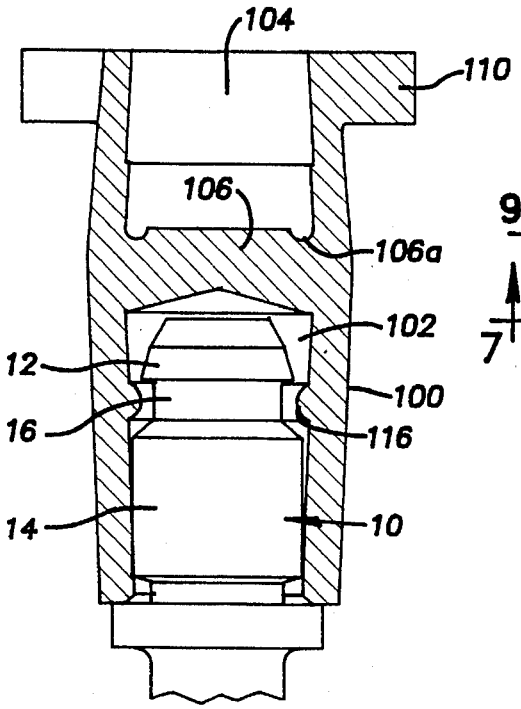
FIG. 5 illustrates the limiter cap of FIGS. 1–4 deformed by an installation tool, thereby allowing its placement on, or removal from, the mixture adjustment screw.

FIG. 5 illustrates the limiter cap 100 deformed by an installation or removal tool (not shown), thereby allowing its placement over or removal from the adjustment screw 10. The bridge 106 is flattened by the tool. The flattened bridge forces the cylindrical body of the cap 100 to expand or deflect radially outwardly. Relief grooves 106*a* formed in the bridge 106 adjacent the cylindrical body reduce the force required to flatten the bridge.

FIGS. 6–9 illustrate another embodiment of a limiter cap 200. The limiter cap 200 fits over the knurled portion 14 of the mixture adjustment screw 10. A pair of opposed ribs 216 extend radially inwardly from an inner surface of the cylindrical body of the cap 200. Each of the ribs 216 provide an arc of approximately 90° of interference with the mixture adjustment screw. The ribs 216 correspond with and fit into the annular groove 16 of the mixture adjustment screw 10. When the cap 200 is pushed over the screw head 14, the ribs 216 snap over the screw head 14 and into the corresponding annular groove 16. Frictional engagement between the cylindrical inner surface of the cap body and the knurled portion 14 of the adjustment screw 10 causes the screw 10 to rotate with the limiter cap 200.

Figure 9:
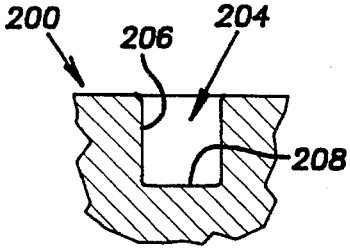
FIG. 9 is an elevational view of the limiter cap, in cross-section, as viewed along lines 9—9 of FIG. 6.

A tapered slot 204 formed in the cylindrical body of the cap 200 receives a flat screw driver (not shown) for rotational adjustment of the mixture adjustment screw 10, and provides an alignment feature for an installation tool. A special tool can be used to engage the tapered portion 204 creating a "wedging" action which spreads the cylindrical body of the cap 200. The tapered portion 204 is aligned with a tapered bore 206 which provides more screw thread engagement while allowing the point of the cap removal tool (not shown) to contact the head of the adjustment screw 10 to assist in pull-out or removal of the cap 200 from the adjustment screw 10. This action reduces or relieves the interference between the ribs 216 and the annular groove 16, and the frictional engagement between the limiter cap body and the knurled portion 14, thereby allowing for easy removal of the limiter cap 200 from the adjustment screw 10. A radially extending protrusion 210 provides interference with a limiter stop, as will be discussed more fully hereafter. The tapered slot 204 slopes to a flattened portion 208, as seen in FIG. 9.

Figure 6:
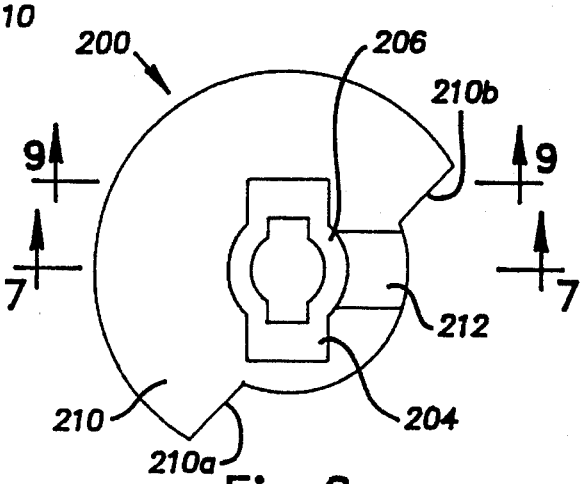
FIG. 6 is a plan view of a second embodiment of a limiter cap according to the present invention.
Figure 7:
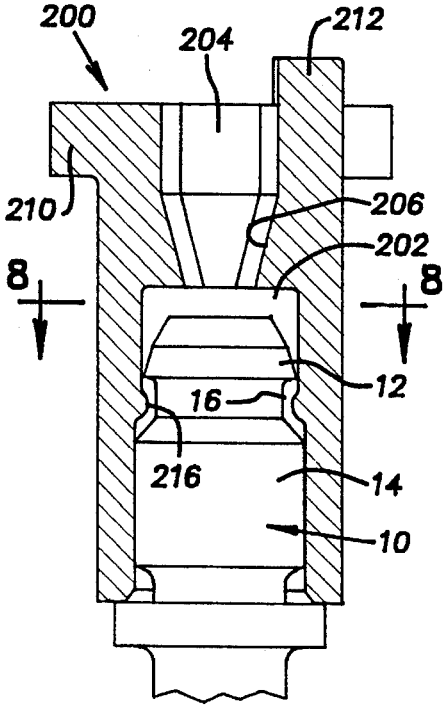
FIG. 7 is an elevational view of the limiter cap as viewed along lines 7—7 of FIG. 6.
Figure 8:
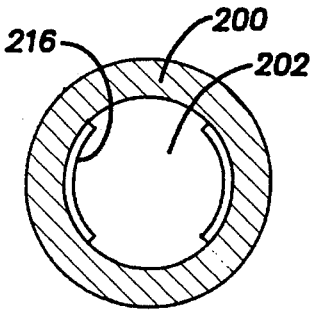
FIG. 8 is a plan view of the limiter cap, in cross-section, as viewed along lines 8—8 of FIG. 7.

The radial protrusion 210 is illustrated in FIGS. 6 and 7 as being at a top of the limiter cap, but may be located at different locations up and down the body of the limiter cap, and is preferably shaped in such a fashion as to provide a pair of radially spaced-apart stop surfaces 210*a*, 210*b*. An axial protrusion 212 extends from the cylindrical body of the limiter cap 200 and provides another stop which may be used to limit rotation of the limiter cap and mixture adjustment screw 10 and provide alignment for an installation or removal tool.

Figure 10:
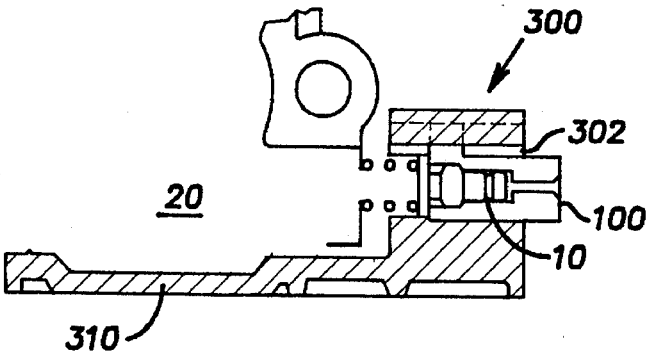
FIG. 10 is a side sectional view illustrating a first embodiment of a limiter stop installed over a limiter cap of FIGS. 1–3 and mixture adjustment screw.
Figure 11:
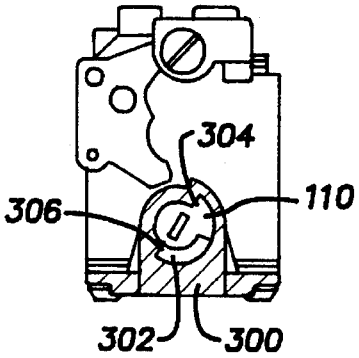
FIG. 11 provides an end view of the first limiter stop illustrated in FIG. 10.
Figure 12:
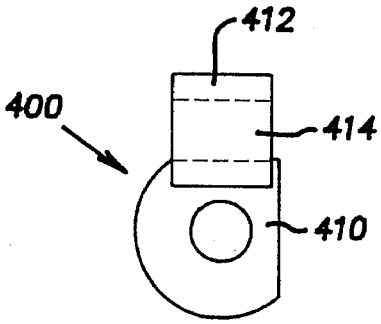
FIG. 12 provides an end elevation view of a second embodiment of the limiter stop.
Figure 13:
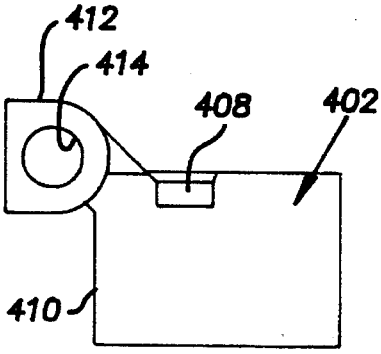
FIG. 13 provides a side elevational view of the second embodiment of the limiter stop illustrated in FIG. 12.
Figure 14:
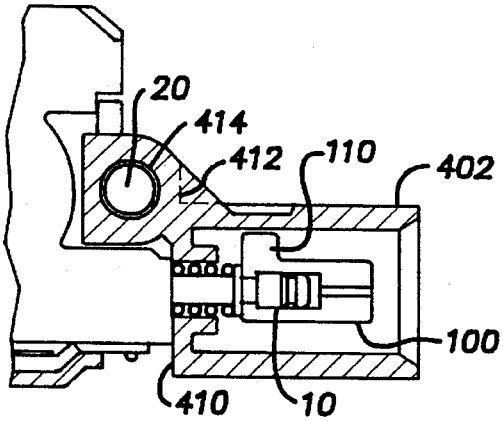
FIG. 14 is a side sectional view of the limiter stop illustrated in FIGS. 12 and 13 attached to a carburetor housing and engaged with the mixture adjustment screw.
Figure 15:
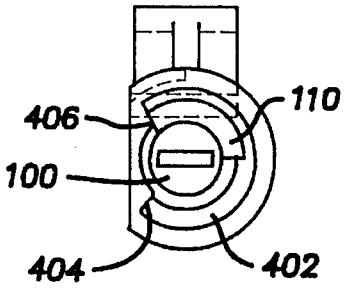
FIG. 15 is an end elevational view of the second limiter stop and the limiter cap shown in FIG. 14.

FIGS. 10 and 11 illustrate a first embodiment of a limiter stop 300 which can work in conjunction with either of the previously described limiter caps 100, 200, the first limiter cap 100 being used for illustration purposes. The limiter stop 300 is a plastic injection molded or die cast part having a tube portion 302 with a central passage which fits around the outer circumference of the limiter cap 100. The central passage is shaped to provide two rotational stops 304, 306 which are positioned to engage the stop surfaces 110*a*, 110*b* of the limiter cap radial protrusion 110. In other words, once installed over the limiter cap 100, the stop 304 will limit the counterclockwise rotation of the cap 100 and coupled adjustment screw 10 due to engagement with the stop surface 110*a*, while the stop 306 will limit clockwise rotation due to engagement with the stop surface 110*b*. The degree or range of rotational motion permitted by the limiter stop 300 can be designed to fit the needs of a particular regulation and a particular engine. The tube portion 302 also provides guidance for the limiter cap installation tool 500, described below with reference to FIGS. 16 and 17. Integral with the limiter stop 300 is the metering cover 310 for the carburetor 20. The metering cover 310 includes the mounting holes, gasket sealing bead and additional features required by the carburetor manufacturer.

FIGS. 12, 13, 14 and 15 illustrate a second embodiment of the limiter stop 400. The limiter stop 400 can also be a plastic injection molded or die cast part having a tube portion 402 with a central passage which fits around the limiter cap 100. The central passage is shaped to provide two rotational stops 404, 406, best shown in FIG. 15, which are engaged by the stop surfaces 110*a*, 110*b* of the limiter cap radial protrusion 110. Rotational stops 404, 406 work in the same manner as the above-described stops 304, 306 of the limiter stop 300. The tube portion 402 also provides guidance for the limiter cap installation tool, described below. The end 410 has a hole which fits over or around the mixture adjustment screw 10. A neck portion 412 with a hole 414 lines up with one of the carburetor mounting screws which secures the limiter stop 400 to the carburetor and prevents rotation of the limiter stop 400 around the mixture adjustment screw 10.

FIGS. 16 and 17 illustrate an installation tool 500 engaging the limiter cap 100. The installation tool 500 includes a handle 502 (not shown), a shaft 504, which has a shape 506 that corresponds to the tube 302, 402 feature of the limiter stop 300, 400, and a blade protrusion 508 that matches the slot 104, 204 in the limiter cap 100, 200 to provide alignment. For service aspects, the tool could be injection molded and formed in such a fashion to fit over the tip of a standard screw driver. The blade 508 can spread the limiter cap 100, 200, as mentioned in the discussion of FIG. 5.

The cap removal method can be accomplished in two ways. When the tool 500 contacts the feature in the bottom of the screw adjustment slot 104, 204, additional pressure must be applied to flatten the feature and deform the limiter cap. The feature in the limiter cap 100 is a bridge 106, while the feature in the limiter cap 200 is a tapered surface 206. In either case, the feature in the bottom of the slot 104, 204 is shaped in such a manner as to provide outward pressure against the cylindrical body of the limiter cap 100, 200 and reducing or eliminating the interference between the limiter cap ribs 116, 216 and the groove 16, and between the inner surface of the mixture adjustment screw 10. The tool 500 must be rotated approximately 90° to secure the tool to the limiter cap and then pulled to remove the cap from the mixture adjustment screw 10.

Alternatively, a screw can be threaded into the bore 108, 206 within the screw adjustment slot 104, 204 of the limiter cap 100, 200. When the screw contacts the feature in the bottom of the screw adjustment slot, it will continue to be threaded into the limiter cap and deform the feature and the limiter cap. The feature in the bottom of the slot (bridge 106 or tapered slot 206) is shaped in such manner as to provide outward pressure against the cylindrical body of the limiter cap, thereby reducing or eliminating the interference between the ribs 116, 216 of the limiter cap 100, 200 and the mixture adjustment screw 10. The screw is then pulled to remove the limiter cap 100, 200 from the mixture adjustment screw 10.

Figure 18:
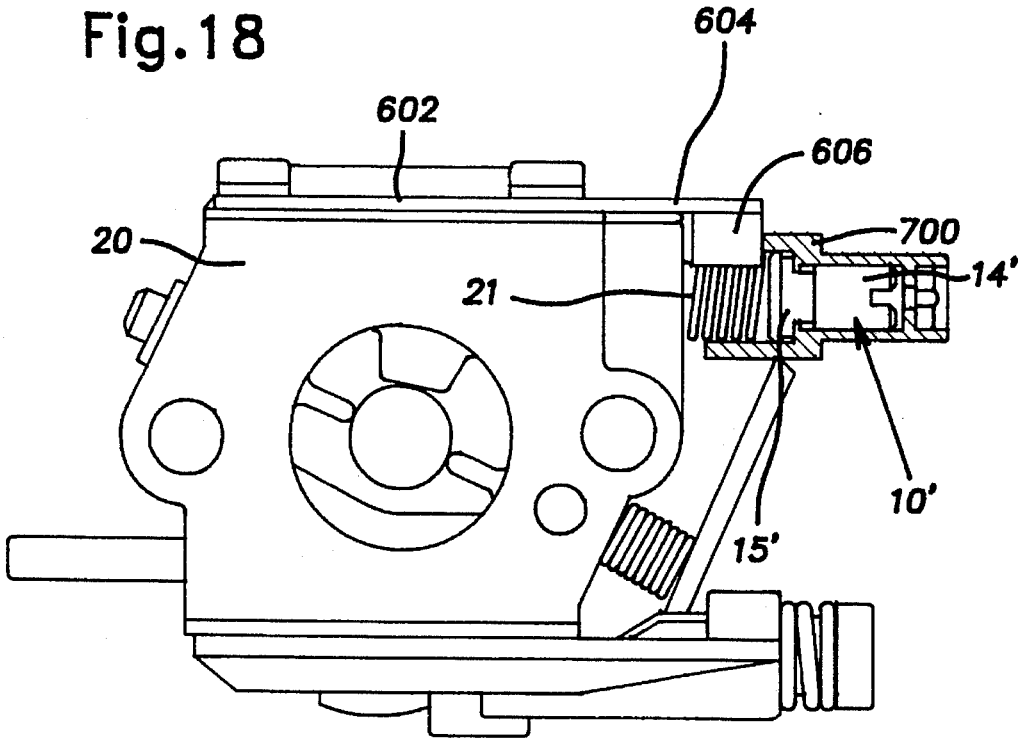
FIGS. 18 and 19 illustrate another limiter device for use in limiting the travel of the mixture adjustment screw attached to a carburetor of a gasoline-powered tool.
Figure 19:
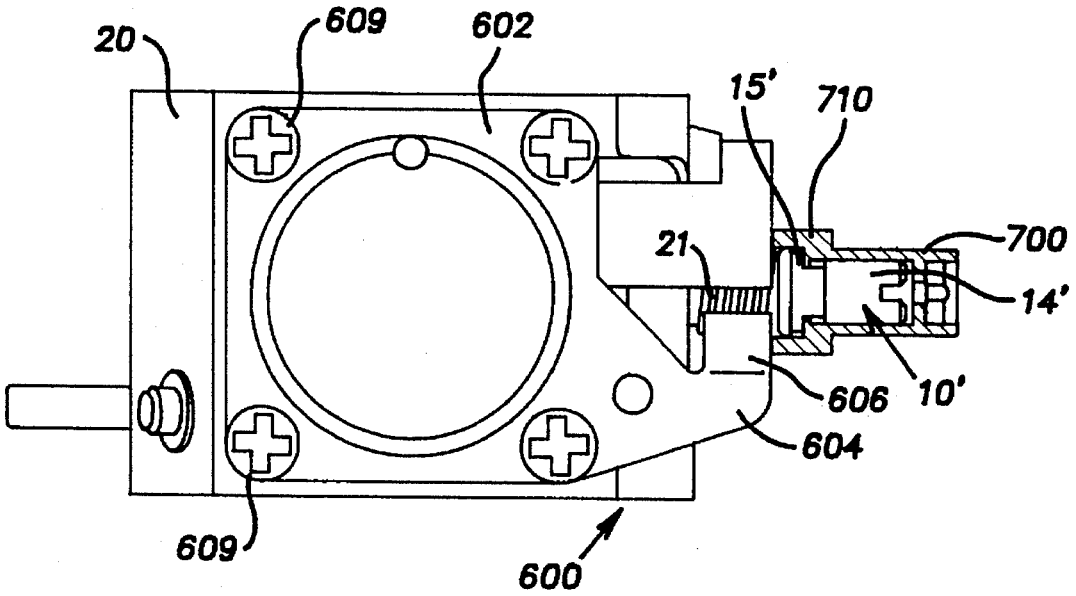

FIGS. 18 and 19 illustrate another embodiment of a limitation device installed on an engine carburetor assembly. The limitation device comprises a diaphragm cover plate 600 which works in conjunction with a limiter cap 700. With reference to FIGS. 18–21, the cover plate 600, which is mounted directly to the body of the carburetor 20, comprises a planar portion 602, an extension portion 604, and an integral tab 606. The tab 606 serves as a rotational stop to limit rotational adjustment of the limiter cap 700, as will be described more fully hereafter.

A plurality of mounting holes 608 in the planar portion 602 accept mounting screws 609. The basic shape of the planar portion 602 of the plate 600 is identical to current production covers, so there is no loss of features or initial design intent. The plate 600 is sufficiently rigid to avoid deformation of the tab 606 during use. A gasket or sealing surface 610 is provided on one side of the planar portion 602 and seals or seats against the carburetor body.

FIGS. 22, 23 and 24 illustrate the limiter cap 700 used in conjunction with the plate 600. The limiter cap 700 is preferably a plastic injection molded part that is pressed on over a knurled head portion 14' and against a radial flange 15' of a mixture adjustment screw 10' after factory setting has been made. The cap 700 provides a cylindrical body 702 which defines a central cavity 703. Integral with a lower or distal end of the cap body 702 is a skirt 710 or wall that extends down over the mixture screw spring 21. The skirt 710 is semi-cylindrical, and has two edges 710*a*, 710*b* that serve as stopping contact surfaces. When the cap 700 is rotated, one of the skirt edges 710*a*, 710*b* engage or abut against the diaphragm cover plate tab 606. Therefore, rotation of the cap 700 is limited in both directions. An upper or proximal end of the cap body 702 is closed or covered by a wall 714. A slot 708 is formed in the wall 714 and is aligned with a bore 706 that opens into the central cavity 703. The bore 706 acts as a pilot hole for a screw or removal tool. An annular surface 715 provided by the cap body 702 abuts or engages the radial flange 15' when the cap 700 is pushed on over the screw 10'. Frictional engagement between the cylindrical body 702 and the knurled head portion 14' forces the screw 10' to rotate with the cap 700.

FIG. 25 discloses a special removal tool 800 for use with the limiter cap 700. The tool 800 is screwed or threaded into the bore 706 in the cap 700. The tool is generally "T" shaped with a handle 802 and a shaft 804. A threaded portion 806 is formed at the distal end of the shaft 804. A flange 808 can be formed between the threaded and unthreaded portion. The tool 800 is typically formed from a high strength steel. In use, the threaded portion 806 is threadingly inserted into the bore 706 in the cap 700. The tool 800 is advanced into the limiter cap by rotating the handle 802. The most distal point of the tool will contact the top of the adjustment screw 10' which will cause the cap 700 to be raised or pushed off of the adjustment screw 10'. The tool 800 may also be simply pulled once threaded into the bore 706 to remove the cap 700 from the mixture adjustment screw 10'. The cap 700 is installed on the screw 10' simply by pushing the cylindrical cap body 702 down over the knurled head portion 14' of the screw with an appropriate tool (not shown).

Although the preferred embodiments of the invention have been described in the foregoing detailed description and illustrated in the accompanying drawings, it should be understood that the invention is not limited to the embodiments disclosed, but is capable of numerous rearrangements, modifications, and substitutions of the parts and elements without departing from the spirit of the invention. Accordingly, the present invention is intended to encompass such rearrangements, modifications, and substitutions of parts and elements as fall within the scope of the invention defined by the claims appended hereto.

What is claimed is:

1. A fuel mixture limitation device for use in a carburetor having an adjustment screw, said limitation device comprising:

(a) a limiter cap removably attached to an exposed portion of the adjustment screw, wherein said limiter cap provides a rotational stop, said limiter cap having a generally cylindrical body defining a central cavity, and compressible expansion means integral with the cylindrical body; and (b) a limiter stop removably attached to the carburetor, wherein said limiter stop provides a stop which cooperates with the rotational stop of the limiter cap to limit rotational adjustment of the adjustment screw.

2. A fuel mixture limitation device according to claim 1, wherein said expansion means comprises a bridge extending across the central cavity.

3. A fuel mixture limitation device according to claim 1, wherein said expansion means comprises a wall which tapers as it extends toward the central cavity.

4. A fuel mixture limitation device for use in a carburetor having an adjustment screw, said limitation device comprising:

a limiter cap removably attached to an exposed portion of the adjustment screw, wherein said limiter cap provides a rotational stop; and a limiter stop removably attached to the carburetor, wherein said limiter stop provides a stop which cooperates with the rotational stop of the limiter cap to limit rotational adjustment of the adjustment screw;

said limiter cap comprising:

a cylindrical body defining a central cavity;

a raised rib protruding inwardly from an inner surface of said body;

compressible expansion means integral with said cylindrical body;

a slot providing access to the expansion means; and a radial protrusion extending outwardly from the cylindrical body, said radial protrusion having a first and a second rotational stop which are operable to engage said limiter stop and thereby limit rotation of said limiter cap in each direction of rotation.

5. The limitation device of claim 4, wherein said expansion means comprises a bridge extending across the central cavity.

6. The limitation device of claim 4, wherein said expansion means comprises a wall which tapers as it extends toward the central cavity.

7. The limitation device of claim 4, wherein said raised rib is disengaged from the adjustment screw upon compression of the expansion means.

8. The limitation device of claim 4, wherein said raised rib is interrupted in two places approximately 180° apart.

9. The limitation device of claim 4, wherein said limiter stop comprises:

(a) a tube portion attached to said carburetor, said tube portion having a central passage wherein said central passage fits around the outer circumference of the limiter cap; and (b) a first and second rotational stop formed on said tube portion.

10. The limitation device of claim 9, wherein said limiter stop comprises a metering cover for the carburetor attached to the tube portion, said metering cover forming an integral part of the carburetor.

11. The limitation device of claim 9, wherein said limiter stop further comprises means for attaching a neck portion to the carburetor.

* * * * *